US006977016B2

(12) United States Patent
Andersson et al.

(10) Patent No.: US 6,977,016 B2
(45) Date of Patent: Dec. 20, 2005

(54) SURFACE MODIFIED STAINLESS STEEL

(75) Inventors: Jan Andersson, Sandviken (SE); Magnus Cedergren, Sandviken (SE)

(73) Assignee: Sandvik AB, Sandviken (SE)

( * ) Notice: Subject to any disclaimer, the term of this patent is extended or adjusted under 35 U.S.C. 154(b) by 181 days.

(21) Appl. No.: 10/616,988

(22) Filed: Jul. 11, 2003

(65) Prior Publication Data

US 2004/0009296 A1 Jan. 15, 2004

Related U.S. Application Data

(62) Division of application No. 09/897,051, filed on Jul. 3, 2001, now Pat. No. 6,627,007.

(30) Foreign Application Priority Data

Jul. 7, 2000 (SE) ..... 0002594

(51) Int. Cl.[7] ..... C21D 1/70
(52) U.S. Cl. ..... 148/262; 148/277; 148/537
(58) Field of Search ..... 148/262, 277, 148/516, 537

(56) References Cited

U.S. PATENT DOCUMENTS 4,709,742 A * 12/1987 Harase et al. ..... 148/542
5,482,731 A * 1/1996 Vargas-Gutierrez et al. ..... 427/2.27
5,578,265 A 11/1996 Ericson et al.
6,197,132 B1 * 3/2001 Andersson-Drugge ..... 148/524
6,261,639 B1 * 7/2001 Shibata et al. ..... 427/383.7
6,355,212 B1 3/2002 Antolotti

FOREIGN PATENT DOCUMENTS

| | | |
|---|---|---|
| GB | 574088 | 12/1945 |
| JP | 60-218429 | * 11/1985 |
| WO | 98/08986 | 3/1998 |

OTHER PUBLICATIONS

P. Y. Hou et al., "Effect of Reactive Element Oxide Coatings on the High Temperature Oxidation Behavior of a FeCrAl Alloy," *J. Electrochem. Soc.*, vol. 139, No. 4, Apr. 1992, pp. 1119-1126.

* cited by examiner

*Primary Examiner*—George Wyszomierski
(74) *Attorney, Agent, or Firm*—Drinker, Biddle & Reath; Ronald L. Grudziecki

(57) ABSTRACT

A method has been developed for surface modifications of high temperature resistant alloys, such as FeCrAl alloys, in order to increase their resistance to corrosion at high temperatures. Coating it with a Ca-containing compound before heat-treating builds a continuous uniform and adherent layer on the surface of the alloy, that the aluminum depletion of the FeCrAl alloy is reduced under cyclic thermal stress. By this surface modification the resistance to high temperature corrosion of the FeCrAl alloy and its lifetime are significantly increased.

31 Claims, 4 Drawing Sheets

* Standard FeCrAl alloy

Ca-coated FeCrAl alloy

* Standard FeCrAl alloy

Ca-coated FeCrAl alloy

SURFACE MODIFIED STAINLESS STEEL

This application is a divisional of application Ser. No. 09/897,051, filed on Jul. 3, 2001 now U.S. Pat. No. 6,627,007.

FIELD OF THE INVENTION

The present invention relates generally to surface modified stainless steel with increased resistance to high temperatures. In particular, it relates to FeCrAl alloys that are modified by the application of a Ca-containing compound on their surface.

DESCRIPTION OF THE RELATED ART

In the description of the background of the present invention that follows reference is made to certain structures and methods, however, such references should not necessarily be construed as an admission that these structures and methods qualify as prior art under the applicable statutory provisions. Applicants reserve the right to demonstrate that any of the referenced subject matter does not constitute prior art with regard to the present invention.

It is known in the art to use FeCrAl alloys for applications with high requirements for heat resistance, such as purification of automobile exhaust gases by using catalytic converters made of metallic substrates, or in electrical resistance heating applications. Aluminum is added to the alloy to form an alumina layer on the surface of the alloy after heat treating the alloy. This alumina is considered to be one of the most stable oxides having low oxidation rate at high temperatures. FeCrAl-alloys, forming aluminum oxide at exposure to high temperatures, e.g. above 1000° C., especially in thinner dimensions, for instance 50 $\mu$m foils for use in catalytic converters in the automobile industry, have a limited lifetime. This is due to breakaway oxidation, oxidation of Fe and Cr and that the matrix is depleted of Al after aluminum oxide formation after certain periods of time of use in cycles of high temperatures.

Common conventional methods of increasing lifetime are the following:

alloying with Rare Earth Metals (REM) and/or Yttrium in order to increase the oxidation resistance of the FeCrAl alloy by supporting the formation of an aluminum oxide layer on the surface of the alloy;

increasing the aluminum content, or the contents of other elements with high oxygen affinity, in the matrix, which often leads to production difficulties such as embrittlement during rolling; and cladding the material with aluminum foils.

These methods have to rely on time consuming diffusion controlled processes.

SUMMARY OF THE INVENTION

It is therefore an object of the present invention to provide a new approach to increase the resistance to corrosion at high temperature, especially at cyclic thermal stress, and thereby increase the lifetime of said type of alloy.

By applying a continuous uniform layer of a Ca-containing compound on the surface of the FeCrAl alloy before annealing, a mixed oxide of Al and Ca is formed during the heat treatment. This treatment gives the advantage of influencing, i.e., hindering, the aluminum oxide formation and nucleation during the beginning of exposure to high temperature, which increases the lifetime more effectively than other methods, e.g., alloying or cladding. The surface has a more compact and homogenous oxide layer with less pores, dislocations and cavities than the previously known alumina layers formed on FeCrAl-alloys after heat treatment. The surface layer acts as barrier for aluminum ions and oxygen to diffuse through the alloy/oxide boundary and the oxidation resistance and lifetime of the alloy are therefore significantly improved. It is believed that the Ca-layer on the surface of the alloy tightens the surface in a way that the alumina depletion of the alloy is drastically reduced. Ca also favors the selective oxidation of Al, which improves the oxidation resistance at elevated temperatures and the lifetime of the alloy.

BRIEF DESCRIPTION OF THE DRAWING FIGURES

DETAILED DESCRIPTION OF THE INVENTION

Figure 1:
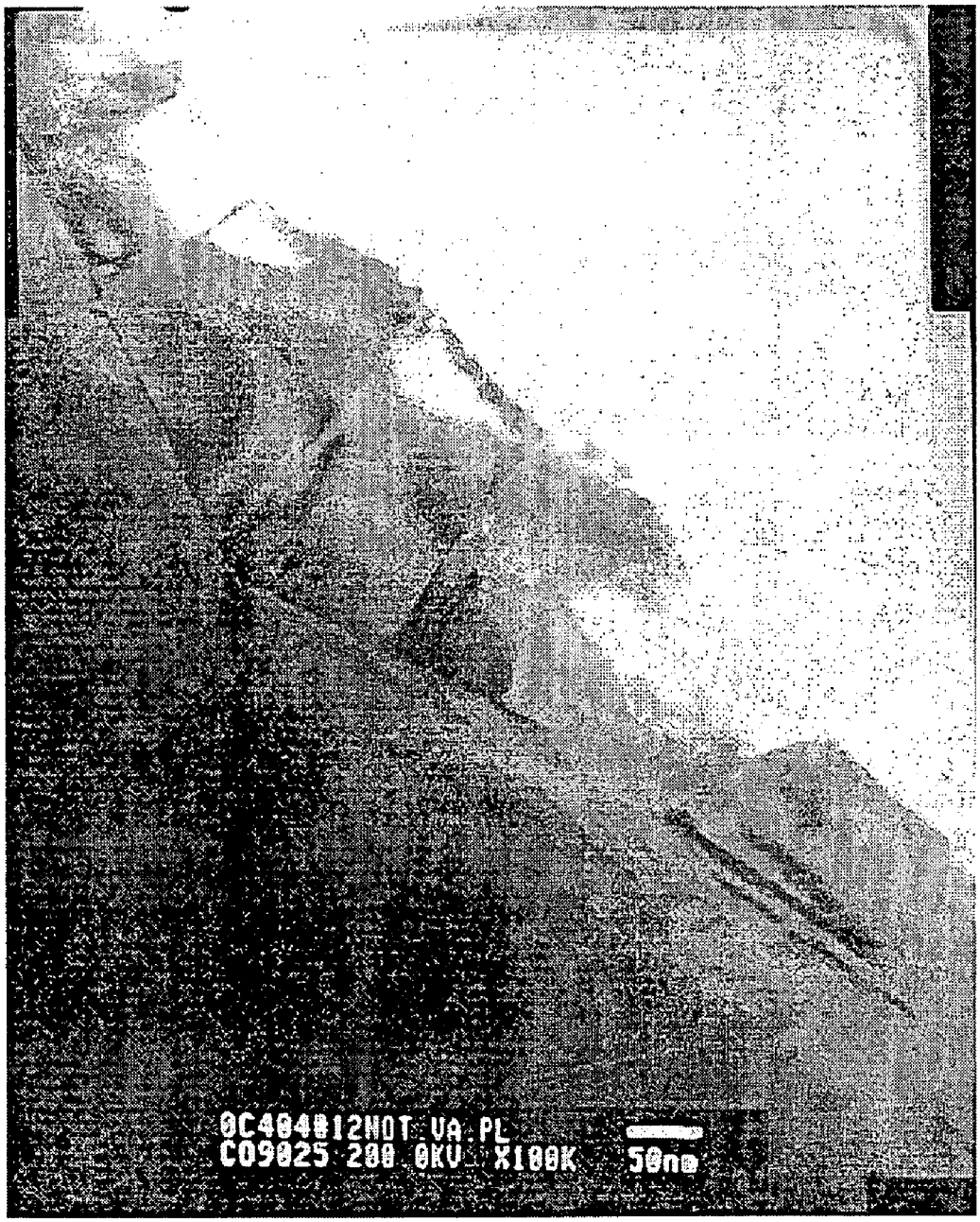
FIG. 1 shows a TEM-micrograph in 100 000× magnification of an embodiment of the present invention.

Generally, certain features of the present invention are shown in FIG. 1, wherein:

A. FeCrAl alloy

B. Columnar aluminum oxide grains.

C. Grain boundary in the oxide.

D. Calcium-containing layer filling in imperfections and grain boundaries in the oxide.

An alloy suitable for being processed according to the present invention includes hotworkable ferritic stainless steel alloys, normally referred to as FeCrAl alloys, that are resistant to thermal cyclic oxidation at elevated temperatures and suitable for forming a protecting oxide layer thereon, such as an adherent aluminum oxide, said alloy comprising or consisting essentially of (by weight) 10–40% Cr, 1.5–8.0% Al, preferably 2.0–8.0%, with or without an addition of REM elements at amounts up to 0.11%, up to 4% Si, up to 1% Mn and normal steelmaking impurities, the remainder being Fe. Such suitable ferritic stainless steel alloys are, for instance, those disclosed in U.S. Pat. No. 5,578,265, which is hereby incorporated by reference and henceforth referred to as STANDARD FeCrAl alloy. These types of alloys are good candidates for final applications, which include electrical resistance heating elements and catalytic substrates such as used in catalytic systems and converters in the automotive industry.

One feature is that the material contains at least 1.5% by weight of aluminum to form alumina as a protective oxide on the surface of the alloy after heat treatment. The method is also applicable to composite materials, such as clad materials, composite tubes, PVD-coated materials, etc. wherein one of the components in the composite material is a FeCrAl alloy as mentioned above. The coated material may also be comprised of a nonhomogeneous mixture of the alloying elements, for instance, a chromium steel coated with aluminum by, for instance, dipping or rolling, where the total composition for the material is within the limit specified above.

The coating method may be applied on any kind of product made of said type of FeCrAl alloy and in form of a strip, bar, wire, tube, foil, fiber etc., preferably in the form of foils, that has good hot workability and which may be used in environments with high demands on resistance to corrosion at high temperatures and cyclic thermal stress. The surface modification will preferably be effected by a part of a conventional production process, but care should of course be taken to other process stages and the final application of the product. It is another advantage of the invention that the Ca-containing compound can be applied independently of the type of FeCrAl alloy or the shape of the part or material to be coated.

A broad variety of methods for the application of the coating media and the coating process may be used as long as they provide a continuous uniform and adherent layer. This may include techniques such as spraying, dipping, Physical Vapor Deposition (PVD) or any other known technique to apply a fluid, gel or powder of a Ca-containing compound on the surface of the alloy, preferably PVD such as disclosed in WO98/08986.

It is also possible to apply the coating in the form of a fine-grained powder. The conditions for applying and forming the Ca-layer on the surface of the alloy may have to be determined experimentally in individual cases. The coating will be affected by factors such as temperature, time of drying, time of heating, composition and properties as well of the alloy as the Ca-containing compound.

Another important issue is that the sample should be cleaned in a proper way to remove oil residues etc., which may affect the efficiency of the coating process and the adhesion and quality of the coating layer.

It is an advantage if this surface modification is included into a conventional production process, preferably before the final annealing. The annealing may be performed in a non-oxidizing atmosphere or in an oxidizing atmosphere for a suitable period of time at 800° C. up to 1200° C., preferably 850° C. to 1150° C. It is also possible to coat the material in several steps to attain a thicker Ca-layer on the surface of the FeCrAl-alloy. In this case one could use different kinds of Ca-containing compounds to reach denser layers. For example it might be convenient to use a Ca-containing compound that adheres well to the metal surface in the first layer and then apply a Ca-containing compound which has a better performance in building a uniform and dense Ca-layer to improve the resistance to high temperature corrosion at cyclic thermal stress.

Furthermore, it might also be possible to apply the coating at different production stages. As an example one could mention cold rolling of thin strips. For example, you might repeatedly roll, clean and anneal the strip several times. Then it might be convenient to apply the coating before each annealing. In this way, the nucleation of the oxide will be enhanced, even though, in applicable cases, the subsequent rolling operation to some extent may partially destroy the oxide layer. It might also be possible to use different kinds of Ca-containing compounds in each step to reach optimum adhesion and quality of the coating layer and to adapt the coating step to the other steps of the production process.

Several different types of Ca-containing compounds, with different compositions and concentrations as described below, may be applied as far as they contain sufficient amounts of Ca in order to obtain a continuous and uniform layer of Ca, that has a thickness of between 10 nm and 3 $\mu$m, preferably between 10 nm and 500 nm, most preferably between 10 nm and 100 nm, and contains between 0.01 wt-% and 50 wt-% of Ca, preferably 0.05 wt-% up to 10 wt-%, most preferably 0.1 wt-% up to 1 wt-%, on the surface of the material. The type of the Ca-containing compound should of course be selected corresponding to the used technique to apply the coating and the production process in total. The compound may, for instance, be in the form of a fluid, gel or powder. Experiments showed good results for colloidal dispersion with a Ca-content of approximately 0.1 vol-%.

A few specific nonlimiting examples of calcium containing compounds, which leave Calcium on the surface and could be used, alone or in combination, include:

a) Soap and degreasing solvents.
b) Calcium nitrate.
c) Calcium carbonate.
d) Colloidal dispersions.
e) Calcium stearate.
f) Calcium oxides.

In the case of fluid compounds the solvent may be of different kinds, water, alcohol, etc. The temperature of the solvent may also vary because of different properties at different temperatures.

Experiments have shown that it is favorable for the coating to have a wide variety in grain size of the Ca-containing compound. A wide variety supports the adherence of the layer on the surface of the FeCrAl alloy. Furthermore, cracks in the Ca-containing surface layer occurring under drying will be avoided. As a result of practical testing it could be stated that drying, if included as a step in the production procedure, should not be carried out at temperatures over approximately 200° C. in order to avoid cracking of the Ca-rich layer. If the size of the Ca-grains exceeds to an amount of approximately 100 nm with a wide variation of grain sizes, the best results for adhesion and homogeneity of the coating layer were obtained. The same result could be obtained if the coating will be carried out in several steps and/or with different Ca-containing compounds in order to obtain a dense film on the surface of the alloy. The time period for the drying should be limited to approximately 30 seconds.

EXAMPLE

Figure 2:
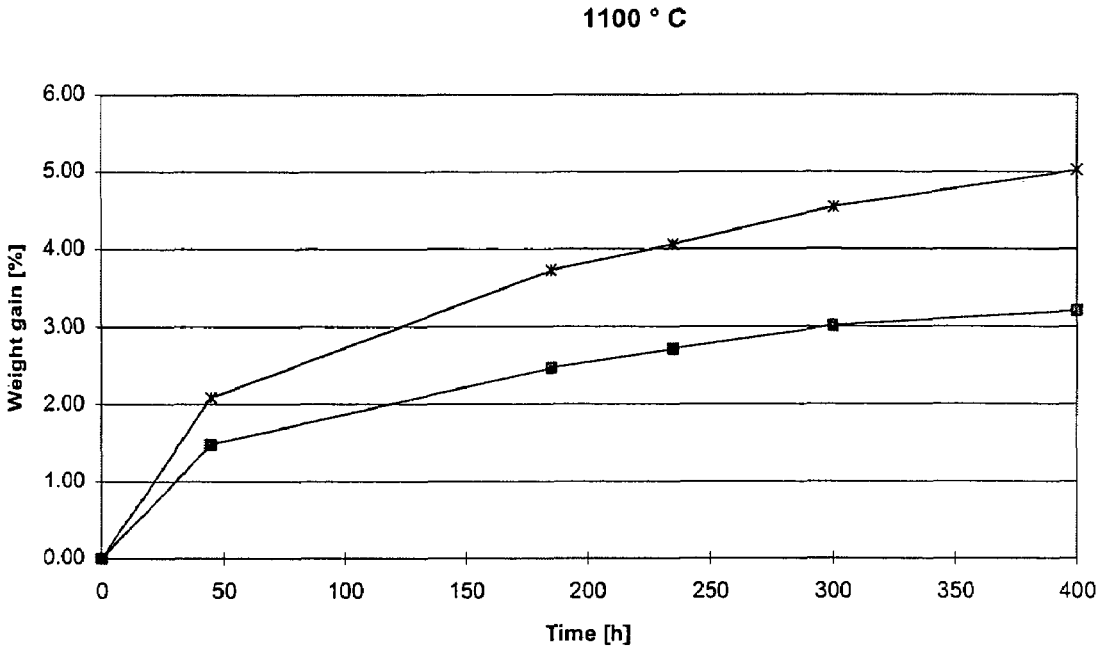
FIG. 2 shows typical results from the oxidation testing performed at 1100° C. for a period of 400 hours, showing the weight gain as a function of time for alloys according to the present invention and the known art.

A foil 50 $\mu$m thick of standard FeCrAl alloy was dipped in a soap solution, dried in air at room temperature and thereafter heat treated for 5 seconds at 850° C. After the coating process samples (30×40 mm) were cut out, folded, cleaned with pure alcohol and acetone. Then the samples were tested in a furnace in 1100° C., normal atmosphere. The weight gain was then measured after different periods of time. This FeCrAl foil with a coating according to the invention had a weight gain of 3.0% after 400 h. A standard, uncoated FeCrAl alloy had a weight gain of 5.0% after 400 h. See FIG. 2. This means in practice a more than doubled lifetime of the foil material Ca-coated according to the invention.

Figure 3:
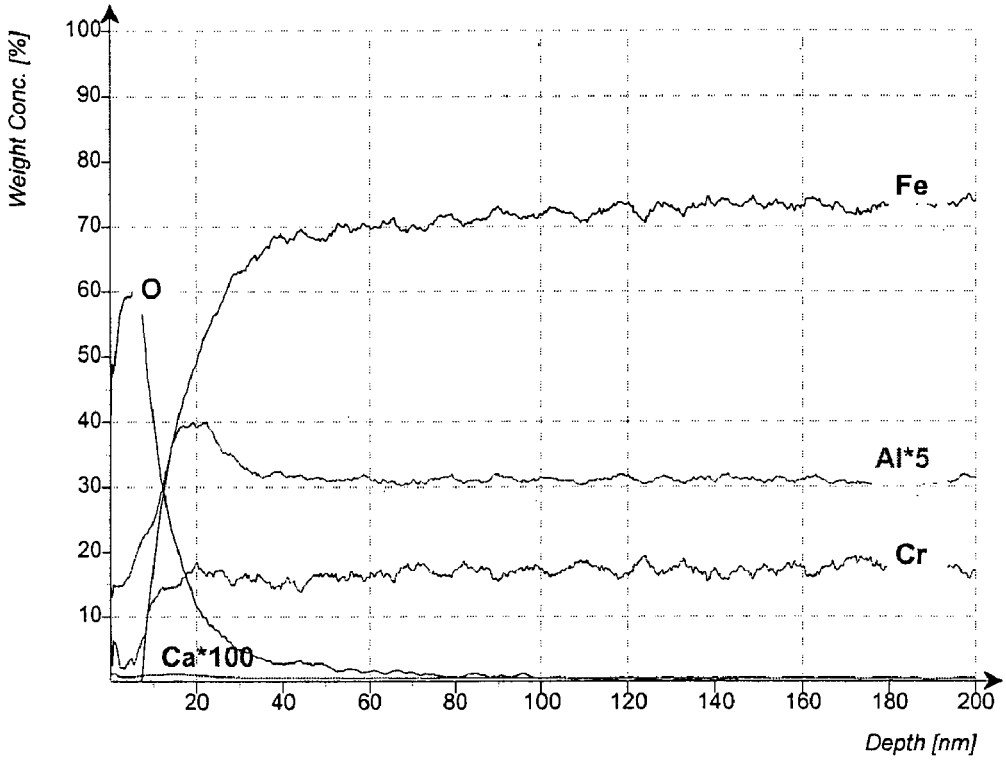
FIG. 3 shows an example of a depth profile measurement on an annealed but not coated material.

The cross section of the surface layer was analyzed using Glow Discharge Optical Emission Spectrometry (GD-OES). Using this technique it is possible to study the chemical composition of the surface layer as a function of the distance from the surface into the alloy. The method is very sensitive for small concentrations and it has a depth resolution of a few nanometers. The result of the GD-OES analysis of the standard foil is shown in FIG. 3. There only exists a very thin passivation layer on this material.

Figure 4:
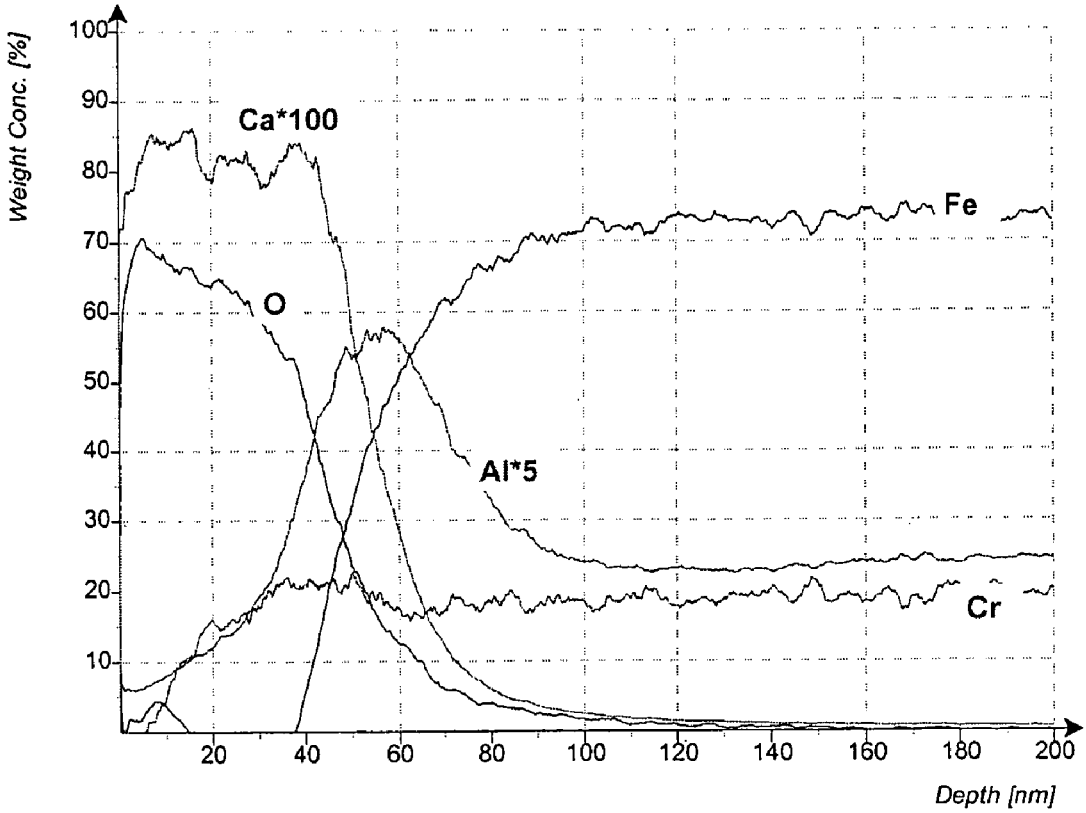
FIG. 4 shows, in the same way, an example of a coated material according to the present invention. In this case, there is found a layer on the surface with a thickness of approximately 50 nm, rich in Calcium.

A foil according to the invention is shown in FIG. 4. From FIG. 4 it is apparent that the Ca-enriched surface layer is about 45 nm thick.

The primary technique for the classification of the materials after the coating process and annealing is of course the oxidation testing. However, using GD-OES and TEM-microscopy etc., it has been possible to adjust the process and to explain the influence of critical parameters, such as concentration of the coating media, thickness of the coating, temperature etc.

We claim:

1. A method of making a heat resistant FeCrAl-alloy with improved oxidation resistance, the method comprising: applying a Ca-containing layer on the surface of the alloy and heat treating in one or more steps, wherein the FeCrAl-alloy comprises at least 1.5 wt. % Al, and wherein the Ca-containing layer has a composition including 0.05 wt. % to 10 wt. % Ca.

2. The method according to claim 1, further comprising heat treating the alloy at a temperature of between 800° C. and 1200° C. in an oxidizing atmosphere.

3. The method according to claim 1, wherein the Ca-containing layer is applied as a Ca-containing compound in the form of calcium carbonate, calcium nitrate, calcium stearate, calcium-rich colloidal dispersion or in the form of calcium oxide or mixtures of such oxides or combinations thereof.

4. The method of claim 3, wherein the Ca-containing compound is in the form of a fluid, a gel or a powder.

5. The method of claim 4, wherein the Ca-Containing compound is a colloidal dispersion with a Ca-content of approximately 0.1 vol. %.

6. The method according to claim 1, wherein the FeCrAI alloy is a strip, a bar, a wire, a tube, a foil or a fiber.

7. The method of claim 1, wherein the heat treatment is performed at 850–1150° C.

8. The method of claim 1, wherein the Ca-containing layer has a thickness of between 10 nm and 3 microns.

9. The method of claim 8, wherein the thickness is between 10 nm and 500 nm.

10. The method of claim 9, wherein the thickness is between 10 nm and 100 nm.

11. The method of claim 1, wherein the composition includes 0.1 wt. % to 1 wt. % Ca.

12. The method of claim 1, comprising at least one drying step at a temperature below approximately 200° C.

13. The method of claim 1, comprising applying at least two Ca-containing layers, wherein Ca-containing compounds in a first Ca-containing layer differ from Ca-containing compounds in a second Ca-containing layer.

14. The method of claim 13, wherein the first Ca-containing layer includes a metal surface adhesion promoting Ca-containing compound and the second Ca-containing layer includes a high temperature corrosion resistant Ca-containing compound and wherein the first Ca-containing layer is a first layer adjacent the surface of the alloy.

15. The method of claim 14, wherein the second Ca-containing layer is an outermost layer.

16. The method of claim 1, wherein the FeCrAl-alloy comprises 1.5 wt. % to 8.0 wt. % Al.

17. A method of making a heat resistant FeCrAl-alloy with improved oxidation resistance, the method comprising:

applying a Ca-containing layer on a surface of the alloy and heat treating in one or more steps, wherein the Ca-containing layer is applied by Physical Vapor Deposition.

18. The method according to claim 17, further comprising heat treating the alloy at a temperature of between 800° C. and 1200° C. in an oxidizing atmosphere.

19. The method according to claim 17, wherein the Ca-containing layer is applied as a Ca-containing compound in the form of calcium oxide or mixtures of such oxides.

20. The method according to claim 17, wherein the FeCrAl alloy is a strip, a bar, a wire, a tube, a foil or a fiber.

21. The method of claim 17, wherein the heat treatment is performed at 850–1150° C.

22. The method of claim 17, wherein the Ca-containing layer has a thickness of between 10 nm and 3 microns and has a composition including 0.01 wt. % to 50 wt. % Ca.

23. The method of claim 22, wherein the thickness is between 10 nm and 500 nm.

24. The method of claim 23, wherein the thickness is between 10 nm and 100 nm.

25. The method of claim 22, wherein the composition includes 0.05 wt. % to 10 wt. % Ca.

26. The method of claim 25, wherein the composition includes 0.1 wt. % to 1 wt. % Ca.

27. The method of claim 17, comprising applying at least two Ca-containing layers, wherein Ca-containing compounds in a first Ca-containing layer differ from Ca-containing compounds in a second Ca-containing layer.

28. The method of claim 27, wherein the first Ca-containing layer includes a metal surface adhesion promoting Ca-containing compound and the second Ca-containing layer includes a high temperature corrosion resistant Ca-containing compound and wherein the first Ca-containing layer is a first layer adjacent the surface of the alloy.

29. The method of claim 28, wherein the second Ca-containing layer is an outermost layer.

30. The method of claim 17, wherein the FeCrAl-alloy comprises at least 1.5 wt. % Al.

31. The method of claim 17, comprising cleaning the surface of the alloy prior to applying the Ca-containing layer.

* * * * *